US011467519B2

(12) United States Patent
Park

(10) Patent No.: US 11,467,519 B2
(45) Date of Patent: Oct. 11, 2022

(54) ERROR DETECTION IN TEMPERATURE SENSORS OF FUSER

(71) Applicant: HEWLETT-PACKARD DEVELOPMENT COMPANY, L.P., Spring, TX (US)

(72) Inventor: Eun-Seok Park, Suwon (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/281,729

(22) PCT Filed: Oct. 8, 2019

(86) PCT No.: PCT/US2019/055197

§ 371 (c)(1),
(2) Date: Mar. 31, 2021

(87) PCT Pub. No.: WO2020/096721

PCT Pub. Date: May 14, 2020

(65) Prior Publication Data

US 2021/0389699 A1 Dec. 16, 2021

(30) Foreign Application Priority Data

Nov. 7, 2018 (KR) ..... 10-2018-0136154

(51) Int. Cl.
*G03G 15/20* (2006.01)
*G03G 15/00* (2006.01)

(52) U.S. Cl.
CPC ..... *G03G 15/205* (2013.01); *G03G 15/5004* (2013.01); *G03G 15/5045* (2013.01)

(58) Field of Classification Search
CPC ..... G03G 15/5045
See application file for complete search history.

(56) References Cited

U.S. PATENT DOCUMENTS

| | | | | |
|---|---|---|---|---|
| 7,881,625 | B2 | 2/2011 | Kinouchi et al. | |
| 2002/0176719 | A1 | 11/2002 | Yogome et al. | |
| 2004/0086295 | A1 * | 5/2004 | Peng | G03G 15/2039 399/69 |

(Continued)

FOREIGN PATENT DOCUMENTS

| | | |
|---|---|---|
| JP | 2007-316169 | 12/2007 |
| JP | 2008-89974 | 4/2008 |
| KR | 10-2006-0015834 | 2/2006 |

*Primary Examiner* — Victor Verbitsky
(74) *Attorney, Agent, or Firm* — Staas & Halsey LLP

(57) ABSTRACT

An image forming apparatus including a print engine, a power supply device, a plurality of temperature sensors, and a processor. The print engine including a fuser. The power supply device to selectively provide power to the fuser. The plurality of temperature sensors including a first temperature sensor and a second temperature sensor to sense temperature of the fuser. The processor to control power supplied to the fuser based on a value measured by at least one temperature sensor from among the plurality of temperature sensors. The processor is to identify whether the at least one temperature sensor of the plurality of temperature sensors has an abnormality based on a first measured temperature value and a second measured temperature value of the plurality of temperature sensors.

13 Claims, 9 Drawing Sheets

(56) References Cited

U.S. PATENT DOCUMENTS

| | | | | |
|---|---|---|---|---|
| 2007/0059005 | A1 | 3/2007 | Fujita et al. | |
| 2008/0212990 | A1 | 9/2008 | Nishi | |
| 2009/0297197 | A1* | 12/2009 | Hase ..... | G03G 15/2042 399/334 |
| 2011/0026947 | A1 | 2/2011 | Hayamizu | |
| 2013/0279933 | A1 | 10/2013 | Tanaka | |
| 2017/0038708 | A1 | 2/2017 | Ikuta et al. | |

* cited by examiner

ERROR DETECTION IN TEMPERATURE SENSORS OF FUSER

CROSS REFERENCE TO RELATED APPLICATIONS

This application is a U.S. National Stage Application which claims the benefit under 35 U.S.C. § 371 of International Patent Application No. PCT/US2019/055197 filed on Oct. 8, 2019, which claims the priority benefit of Korean Patent Application No. 10-2018-0136154 filed on Nov. 7, 2018, the contents of each of which are incorporated herein by reference.

BACKGROUND

An image forming apparatus refers to an apparatus which generates, prints, receives, and transmits image data. Examples of such an image forming apparatus include a copier, a printer, a facsimile, or a multifunction peripheral (MFP) that combines the functions thereof.

An image forming apparatus can form an image in various ways. One of the ways is electrophotography. The electrophotography is a process of forming an image through a process of charging a surface of a photoreceptor, forming a latent image through light exposure, performing a developing job to apply toner to the latent image, transferring the developed toner onto a printing paper, and fixing the toner.

As described above, an image forming apparatus may have a configuration in which an image is finally fixed on the printing paper. This configuration is referred to as a fuser.

DETAILED DESCRIPTION

Hereinafter, various examples will be described in detail with reference to the drawings. The examples described below may be modified and implemented in various different forms. In order to more clearly describe the features of the examples, a detailed description of known matters to those skilled in the art will be omitted.

Meanwhile, in the present specification, when an element is referred to as being "connected" with another element, it includes a case of being directly connected, but also includes a case of being connected with another element in between. Also, when an element is referred to as "including" another element, it may refer to that the element may not exclude another element but may further include other elements, unless specifically stated otherwise.

In the present specification, the term "image forming job" may mean various jobs (e.g., printing, scanning or faxing) related to an image, such as forming the image or generating/storing/transmitting an image file, and the term "job" may mean the image forming job but also may mean a series of processes necessary for performing the image forming job.

Also, the term "image forming apparatus" refers to an apparatus that prints print data generated by a terminal apparatus such as a computer on a recording paper. Examples of such an image forming apparatus include a copier, a printer, a facsimile, or a multi-function printer (MFP) that combines functions thereof through a single apparatus. The image forming apparatus may mean any apparatus capable of performing the image forming job, such as the printer, a scanner, a fax machine, the MFP, or a display apparatus.

Also, the term "print data" may mean data converted into a printable format by the printer. Meanwhile, when the printer supports direct printing, the file itself may be print data.

Also, the term "user" may mean a person who performs an operation related to the image forming operation using an image forming apparatus or a device connected with the image forming apparatus by wired or wirelessly. The term "manager" may mean a person who has authority to access all functions and systems of the image forming apparatus. The "manager" and the "user" may be the same person.

Figure 1:
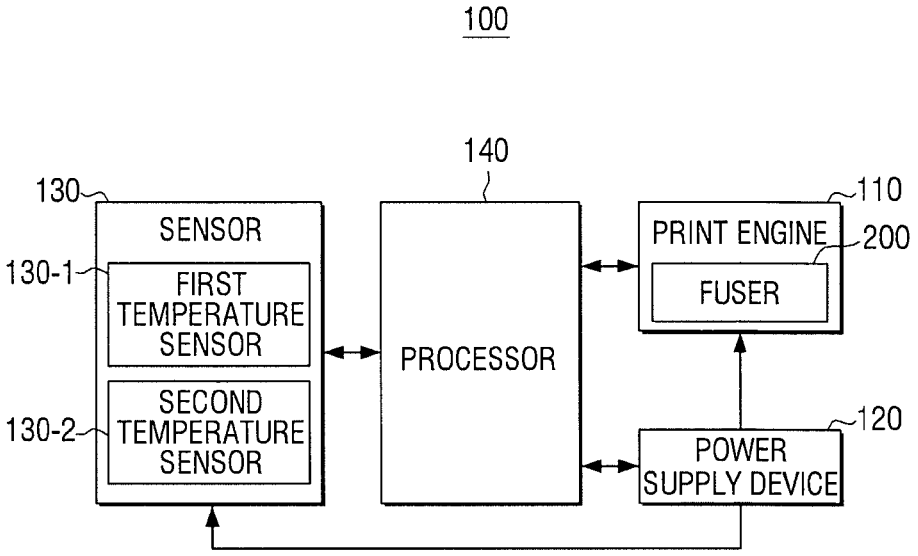
FIG. 1 is a block diagram which illustrates a simple configuration of an image forming apparatus according to an example.

FIG. 1 is a block diagram which illustrates a simple configuration of an image forming apparatus according to an example.

Referring to FIG. 1, an image forming apparatus 100 may include a print engine 110, a power supply device 120, a sensor 130, and a processor 140.

The print engine 110 performs an image forming job. For example, the print engine 110 can form an image on the printing paper in an electrophotographic manner. To this end, the print engine 110 may include a photosensitive drum (not shown), a charger (not shown), an exposure device (not shown), a developing device (not shown), a transfer device (not shown), and a fuser 200.

First, an electrostatic latent image may be formed on the photosensitive drum. The exposure device can change the surface potential of the photosensitive drum in accordance with information of an image to be printed, thereby forming an electrostatic latent image on the surface of the photosensitive drum. The developing device accommodates the developer therein, and can supply the developer to the electrostatic latent image to develop the electrostatic latent image into a visible image. The visible image formed on the photosensitive drum can be transferred to the printing paper by a transfer device or an intermediate transferring belt (not shown).

The fuser 200 fixes a visible image on the printing paper. For example, the fuser 200 can apply heat and pressure to the printing paper to fix the charging toner on the printing paper. The fuser 200 may include a heating roller and a pressure roller.

A heating roller is heated to a predetermined temperature to apply heat to the printing paper so that the charging toner is easily fixed on the printing paper. The heating roller includes a heating element (for example, a heater lamp) for heating the heating roller to a predetermined temperature. The heating element may be a single heating element, or may be composed of a plurality of heating elements. Such a heating element may be heated by a power supply provided in the power supply device 120.

The pressure roller provides a high pressure to the printing paper so that the charging toner is easily fixed on the printing paper. For example, the pressure roller can be attached with a heating roller on the surface of the pressure roller, so that a constant nip can be maintained. The pressure roller may be provided with an elastic layer and a release layer on the upper part of the cylindrical core.

The power supply device 120 supplies power to each configuration in the image forming apparatus 100. For example, the power supply device 120 can convert an AC power supplied from the outside into a DC power, and provide the converted DC power to each configuration in the image forming apparatus 100.

At this time, the power supply device 120 may provide power to the configuration corresponding to the operation mode of the image forming apparatus 100. For example, when the image forming apparatus 100 is in the print mode, the power supply device 120 can supply power to all the configurations in the image forming apparatus 100. Conversely, when the image forming apparatus 100 is in the standby mode, the power supply device 120 can supply power to a part of the components in the image forming apparatus 100.

The power supply device 120 may selectively provide AC power provided from an external source to the fuser 200. For example, the power supply device 120 may selectively provide AC power to the fuser 200 under the control of the processor 140. To this end, the power supply device 120 may include a switching element for selectively outputting an AC power source, and may include a zero cross sensor for sensing zero crossing of the AC power.

The sensor 130 senses the temperature of the fuser 200. Such sensor 130 may include a non-contact temperature sensor that is not contact with the heating roller. In the meantime, the sensor 130 may include a contact type temperature sensor at the time of implementation, but in the following description, it is assumed that the sensor 130 includes a non-contact type temperature sensor. For example, the sensor 130 may include a thermistor and may include a thermocouple or a resistance temperature detector (RTD).

The sensor 130 may be disposed at a position spaced apart from the fuser 200 by a predetermined distance to sense the temperature of the fuser 200. Such sensor 130 may be disposed in a central area of the fuser 200 and may be disposed in a lateral area of the fuser 200.

The aforementioned sensor 130 may include a plurality of temperature sensors. For example, as illustrated in FIG. 1, the sensor 130 may include two temperature sensors 130-1 and 130-2.

Here, the first temperature sensor 130-1 may operate as a main temperature sensor, and the second temperature sensor 130-2 may operate as a sub temperature sensor. The main temperature sensor is a sensor for measuring the surface temperature of the fuser, and the sub temperature sensor is a sensor to perform a function for compensating the temperature measured by the main temperature sensor or a function for checking the error of the main temperature sensor.

For this operation, the first temperature sensor 130-1 may be disposed to be directly exposed to the fuser 200, and the second temperature sensor 130-2 may be disposed not to be exposed to the fuser 200, but may be located near the first temperature sensor 130-1 to sense the ambient temperature.

The first temperature sensor 130-1 may output temperature information corresponding to the changed resistance value when the resistance value included therein is changed by the energy emitted from the fuser 200. However, changing the resistance value can be caused by the influence of the ambient temperature of the first temperature sensor 130-1 in addition to the energy dissipated from the fuser 200, and the temperature information output from the first temperature sensor 130-1 may include errors due to peripheral influences.

The second temperature sensor 130-2 can detect ambient temperature without being exposed to the fuser 200 and may detect temperature corresponding to an error included in temperature sensed by the first temperature sensor 130-1.

Therefore, when the temperature sensed by the first temperature sensor 130-1 is corrected using the temperature sensed by the second temperature sensor 130-2, the temperature of the fuser 200 from which the error is eliminated can be obtained. Thus, compared to a method for detecting temperature of the fuser 200 using one temperature sensor, the image forming apparatus 100 can sense temperature of the fuser 200 more correctly.

The temperature sensed by the first temperature sensor 130-1 may be referred to as sensed temperature, and the temperature sensed by the second temperature sensor 130-2 may be referred to as compensated temperature. The specific configuration of the sensor 130 will be described later with reference to FIG. 5.

The processor 140 controls each configuration in the image forming apparatus 100. To be specific, the processor 140 may be implemented as CPU, ASIC and so on, and may determine an operation mode of the image forming apparatus 100.

For example, when it is determined that the image forming apparatus 100 is initialized or the print job is to be started soon (for example, when the user controls the input device or receives print data), the processor 140 can determine the operation mode of the image forming apparatus 100 as a normal mode (or a print mode, a normal mode). In addition, the processor 140 may control the power supply device 120 such that the fuser 200 has a fusing temperature in accordance with the initial state.

The processor 140 may determine the operation state of the image forming apparatus 100 to be in the standby mode after a predetermined time has elapsed since the completion of the printing operation. The processor 140 may then control the power supply device 120 to maintain the temperature of the fuser 200 below the temperature for fusing.

Meanwhile, the processor 140 may receive the temperature information from the sensor 130 to confirm the temperature of the fuser 200 so that the fuser 200 has a fixing temperature corresponding to the operation mode. For example, the processor 140 can check the temperature of the fuser 200 based on the values measured by at least one of the temperature sensors 130-1 and 130-2.

For example, the temperature of the fuser 200 can be confirmed using the temperature value sensed by the first temperature sensor 130-1 directly exposed to the fuser 200. In another example, the processor 140 may use sensed temperature which is sensed by the first temperature sensor 130-1 but also may use compensated temperature which is sensed by the second temperature sensor 130-2 which is not exposed to the fuser 200 but can sense the ambient temperature, and may check temperature of the fuser 200 more accurately.

When it is determined that the fuser 200 is overheated, the processor 140 may control the power supply device 120 to block power provided to the fuser 200.

The processor 140 can check whether the sensor 130 is abnormal by using the received temperature information. For example, the processor 140 can check whether the sensor 130 is abnormal by using a characteristic that appears between the sensed temperature and the compensated temperature.

As described above with respect to the sensor 130, the first temperature sensor 130-1 may be disposed to be directly exposed to the heating roller, and the second temperature sensor 130-2 may be disposed not to be exposed to the heating roller.

Therefore, in general, the temperature sensed by the first temperature sensor 130-1 may be greater than the compensated temperature sensed by the second temperature sensor 130-2. However, when an abnormality occurs in the sensor 130 or an abnormality occurs in the connection end of the sensor 130, the sensed temperature may have a value smaller than the compensated temperature.

Therefore, the processor 140, if it is checked that the compensated temperature is greater than the sensed temperature, may determine that there is an abnormality in the sensor 130 or the connection end of the sensor 130.

In the meantime, even when the compensated temperature is greater than the sensed temperature, there may occur a case where the compensated temperature is temporarily higher than the sensed temperature because an external wind blows to the fuser 200 or an object having a low temperature is touched. The processor 140 may determine that an abnormality has occurred in the sensor 130 or the like if the difference between the sensed temperature and the compensated temperature is greater than a predetermined value.

Here, the predetermined value may refer to the difference between the sensed temperature and the compensated temperature which is sufficient for the determination that the sensor 130 has an abnormality, and this value can be set by a manufacturer.

If it is determined that the processor 140 has an abnormality, the processor 140 may display a guide to a problem that has occurred to the user. In addition, the processor 140 may control the power supply device 120 to block power supplied to the fuser 200.

In describing FIG. 1, it is described that the temperature sensor includes the first temperature sensor and the second temperature sensor, but in implementation, three or more temperatures can be included.

Simple configurations of the image forming apparatus have been described above, but in implementation, various configurations can be further included. This will be described with reference to FIG. 2.

Figure 2:
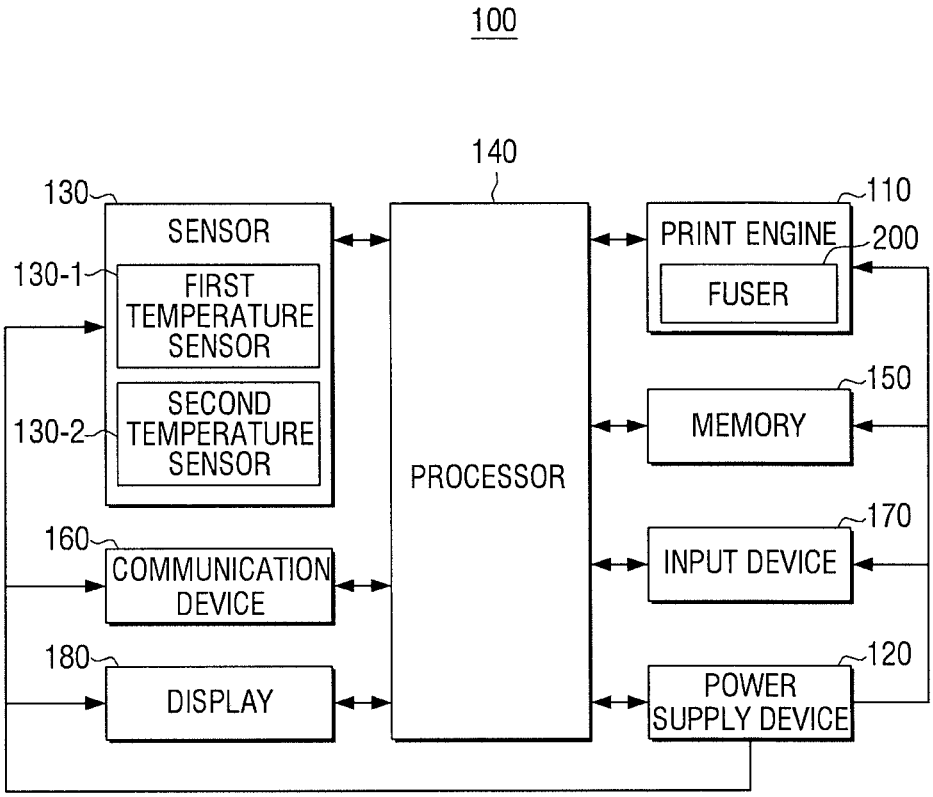
FIG. 2 is a block diagram which illustrates a detailed configuration of an image forming apparatus according to an example.

FIG. 2 is a block diagram which illustrates a detailed configuration of an image forming apparatus according to an example.

Referring to FIG. 2, the image forming apparatus 100 may include the print engine 110, the power supply device 120, the sensor 130, the processor 140, the memory 150, the communication device 160, an input device 170, and a display 180.

The print engine 110, the power supply device 120, and the sensor 130 perform the same functions as those in FIG. 1, and redundant description will be omitted. The processor 140 is also described with reference to FIG. 1. The contents described in FIG. 1 are not duplicated and the contents related to the configuration added in FIG. 2 will be described below.

The memory 150 may store print data. For example, the memory 150 may store the print data received from the communication device 160 described above. The memory 150 may be implemented as a storage medium in the image forming apparatus 100, but also may be implemented as an external storage medium, a removable disk including a USB memory, a web server via a network, and the like.

The memory 150 may store a fuser temperature table corresponding to the difference between the sensed temperature and the compensated temperature. The processor 140 may receive information on the sensed temperature and the compensated temperature from the sensor 130 and check whether the current fuser 200 is overheated using the fuser temperature table stored in the memory 150, and control the power supplied to the fuser 200 based on the checked results.

The memory 150 may store an abnormality determination table corresponding to the difference between the sensed temperature and the compensated temperature. The processor 140 may receive the information about the sensed temperature and the compensated temperature from the sensor 130, check whether or not an abnormality has occurred to the current sensor 130 or the connection terminal of the sensor 130 using the abnormality determination table stored in the memory 150, control power provided to the fuser 200 or guide error occurrence to a user using the check result.

The communication device 160 is formed to connect the image forming apparatus 100 to an external device and is connected through a local area network (LAN) and an Internet network but also is connected through a Universal Serial Bus (USB) Port and a wireless module. Here, the wireless module may be WiFi, WiFi Direct, Near Field Communication (NFC), Bluetooth, and the like.

The communication device 160 can receive a job execution command from an external device (not shown). The communication device 160 may transmit and receive data related to the above-described job execution command. For example, if the user's job command is printing for a specific file, the communication device 160 may receive the print file. Here, the print file may be data in a printer language such as PostScript (PS), Printer Control Language (PCL), or the like, and may be a file itself such as PDF), XPS, BMP, and JPG.

The input device 170 includes a plurality of function keys for a user to set or select functions available by the image forming apparatus 100. Through this, the user may input various driving commands regarding the image forming apparatus 100.

The display 180 displays various information provided by the image forming apparatus 100. For example, the display 180 may display an operation mode of the image forming apparatus 100, or may display a user interface window for selecting various functions and options that the user can select.

When it is confirmed that an abnormality has occurred to the sensor 130 or the connection terminal of the sensor 130, the display 180 may display a guide regarding the abnormality according to a control of the processor 140.

As described above, the image forming apparatus according to the present example may detect whether or not an abnormality occurs in a temperature sensor or a connection terminal of a temperature sensor, as well as whether or not an overheating of the fuser occurs by using the sensed temperature and the compensated temperature sensed by the temperature sensor. Therefore, overheating of a fuser due to recognizing an abnormality in the temperature sensor as a normal state can be prevented.

In the above description, it has been described that the temperature information detected by the temperature sensor is acquired by the processor to determine whether or not there is an abnormality in the temperature sensor. Hereinafter, the operation of detecting the abnormality of the temperature sensor in a circuit configuration will be described with reference to FIGS. 3 and 4.

Figure 3:
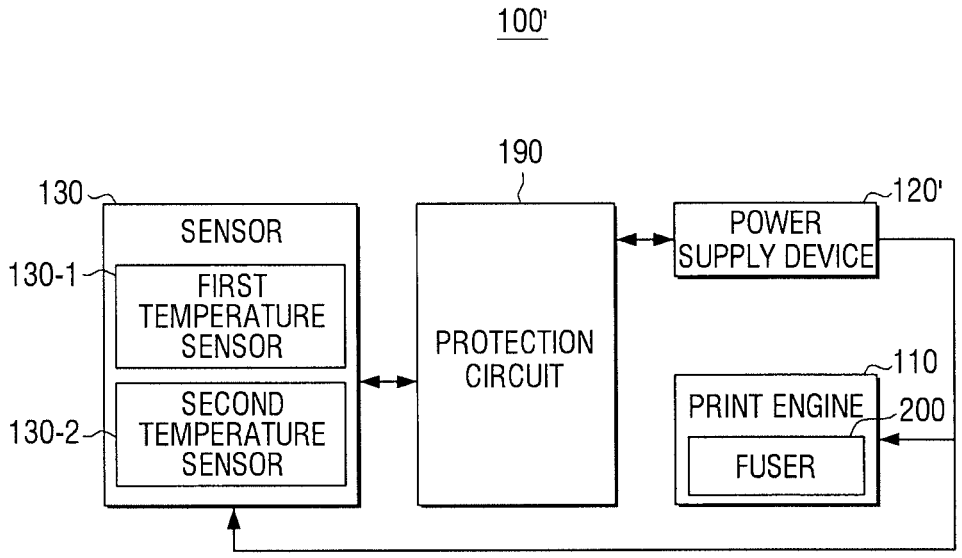
FIG. 3 is a block diagram which illustrates a simple configuration of an image forming apparatus according to another example.

FIG. 3 is a block diagram which illustrates a simple configuration of an image forming apparatus according to another example.

Referring to FIG. 3, an image forming apparatus 100' may include the print engine 110, a power supply device 120', the sensor 130, and a protection circuit 190.

The print engine 110 performs the same functions as the configuration of FIG. 1, and redundant description is omitted. The power supply device 120' and the sensor 130 have been described with reference to FIG. 1, so the contents described in FIG. 1 will not be described in duplicate and the contents related to the configuration added in FIG. 3 will be described.

The sensor 130 may include a plurality of temperature sensors 130-1 and 130-2 and temperature information indicating a temperature value sensed by each of the plurality of temperature sensors 130-1 and 130-2 can be output to the protection circuit 190.

The protection circuit 190 may check whether the overheating of the fuser 200 and the abnormality of the sensor 130 have occurred during the operation of the processor 140 of FIGS. 1 and 2 and control the power supply device 120'. The specific operation of the protection circuit 190 will be described below.

First, the protection circuit 190 can receive an output value from each of the plurality of temperature sensors 130-1 and 130-2. For example, the protection circuit 190 may receive a sensed voltage corresponding to the sensed temperature sensed by the first temperature sensor 130-1 and a compensated voltage corresponding to the compensated temperature sensed by the second temperature sensor 130-2.

The protection circuit 190 may check whether overheating of the fuser 200 occurs using the input voltage, and provide a signal corresponding to the checked result to the power supply device 120'.

For example, as described above, the sensed temperature may have a value larger than the compensated temperature. In the meantime, the temperature value sensed by the sensor 130 and the voltage corresponding to the temperature value are inversely proportional to each other. Therefore, it is general that the sensed voltage may have a value smaller than the compensated voltage.

Therefore, the protection circuit 190 compares the sensed voltage and the compensated voltage, and if the compensated voltage is greater than the sensed voltage by a predetermined value or more, it is considered that the fuser 200 is overheated, and an overheating occurrence signal can be provided to the power supply device 120'. To this end, the protection circuit 190 may include a comparator (not shown).

In this way, the protection circuit 190 senses whether the fuser 200 is overheated and transmits a signal to the power supply device 120' separately from the processor 140'. Therefore, even in a case where the processor 140' has a problem and control of the power supply device 120' is not normal, there is an effect of preventing overheating of the fuser 200.

The protection circuit 190 may check whether there is an abnormality in the sensor 130 using the input voltage and provide a signal corresponding to the checked result to the power supply device 120'.

To be specific, if there is an abnormality occurs to the sensor 130 or the connection terminal, the sensed voltage may be greater than the compensated voltage.

Therefore, the protection circuit 190 compares the sensed voltage with the compensated voltage, and if the sensed voltage is greater than the compensated voltage by a predetermined value or more, it is considered that an abnormality occurs in the sensor 130 or the like, and provides the power supply device 120' an abnormality occurrence signal. The specific configuration of the protection circuit 190 will be described later with reference to FIGS. 6 to 8.

The protection circuit 190 senses the abnormality of the sensor 130 separately from the processor 140' and transmits a signal to the power supply device 120' and thus, even in a case where the processor 140' has a problem and control of the power supply device 120' is not normal, there is an effect of preventing overheating of the fuser 200.

In addition to a control command received from the processor 140', if the power supply device 120' receives a signal of overheating or an abnormality occurrence, the power supply device may block power supplied to the fuser 200.

In describing FIG. 3, it has been described that a sensor includes two temperature sensors, but in implementation, three or more temperature sensors can be provided.

Until now, a simple configuration of the image forming apparatus has been described, but in implementation, various configurations can be further added. This will be described with reference to FIG. 4.

Figure 4:
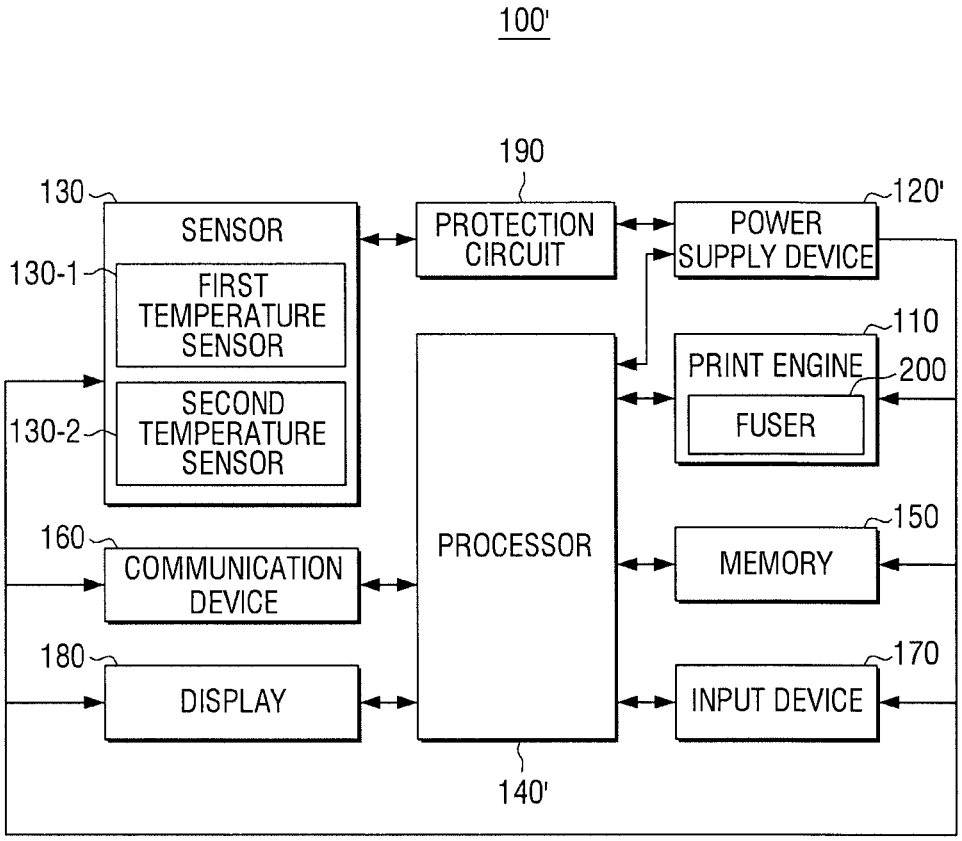
FIG. 4 is a block diagram which illustrates a detailed configuration of an image forming apparatus according to another example.

FIG. 4 is a block diagram which illustrates a detailed configuration of an image forming apparatus according to another example.

Referring to FIG. 4, the image forming apparatus 100' may include the print engine 110, the power supply device 120', the sensor 130, the processor 140', the memory 150, the communication device 160, the input device 170, the display 180, and the protection circuit 190.

The print engine 110, the power supply device 120' and the sensor 130 perform the same functions as the configuration of FIG. 3, and the memory 150, the communication device 160, and the input device 170 perform the same function as that of FIG. 1, and redundant description is omitted. The protection circuit 190 has been described with reference to FIG. 3. Therefore, the contents described in FIG. 3 are not duplicated and the contents related to the configuration added in FIG. 4 will be described.

The protection circuit 190 may sense abnormality occurrence of a sensor using the sensed voltage and the compensated voltage input from the sensor 130, and provide a signal corresponding to the sensed result to the power supply device 120' and the processor 140'.

The processor 140', when receiving a signal corresponding to a result of abnormality occurrence of the sensor 130 from the protection circuit 190, may take an appropriate measure corresponding thereto.

For example, when the abnormality signal is received, the processor 140' may block power of the power supply device 120' separately from the protection circuit 190, or display a guide regarding a problem of a user through the display 180.

As described above, the image forming apparatus according to the present example can detect whether or not an abnormality occurs in a sensor or a connection end of a sensor in addition to the occurrence of overheating of the fuser by using the sensed temperature and the compensated temperature sensed by the sensor. Therefore, it can be prevented a case in which, even though there is an abnormality to a user, it is recognized as a normal state, and a fuser is overheated, and a case in which control of a fuser is not normally performed and a fuser is overheated.

The image forming apparatus according to the present example detects overheating of a fuser or abnormality of a temperature sensor through circuit configuration and can check abnormality of a fuser more rapidly. Therefore, there is an effect of preventing product liability due to overheating or the like.

In implementation, the aforementioned overheating or abnormality in a temperature sensor can be implemented in any of a processor or a protection circuit, or can be implemented by both a protection circuit and a processor.

Figure 5:
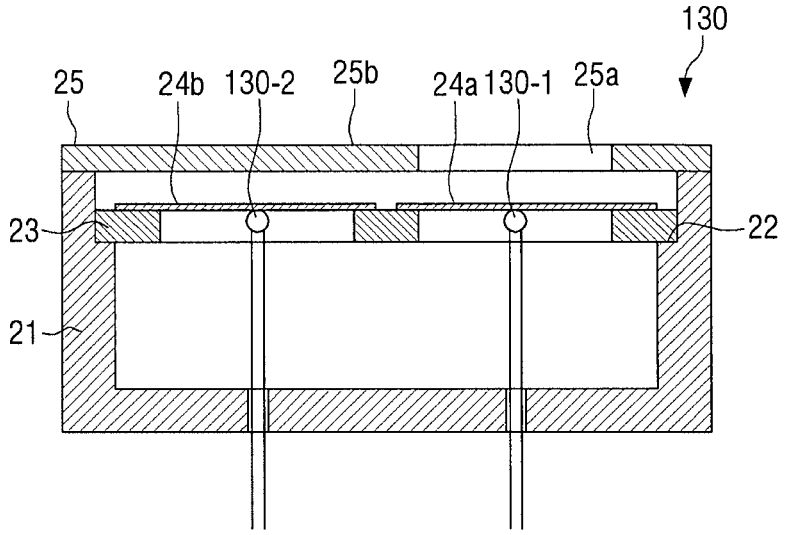
FIG. 5 is a view which illustrates an example of a detailed configuration of a sensor.

FIG. 5 is a view which illustrates an example of a detailed configuration of a sensor.

Referring to FIG. 5, the sensor 130 includes a plurality of temperature sensors 130-1 and 130-2 which sense temperature by a non-contact method.

The sensor 130 is disposed to be distant from the fuser 200 by a predetermined distance or more and may sense temperature of the fuser 200 using the plurality of temperature sensors 130-1, 130-2.

The sensor 130 may include a case 21, resin films 24*a* and 24*b*, a fixed frame 23 for fixing the resin films 24*a* and 24*b*, and a cover including an incident window 25*a* and a shielding portion 25*b*. A protrusion 22 is formed in the case 21 so that the fixing frame 23 can be fixed by a method such as adhesion.

The first temperature sensor 130-1 and the second temperature sensor 130-2 can be fixed to be adhered to one side of the resin films 24*a*, 24*b*.

The cover 25 has a structure in which the incident window 25*a* is positioned on a part of the first temperature sensor 130-1 and the shielding portion 25*b* is located on the second temperature sensor 130-2. Therefore, the energy emitted from the fuser 200 can reach the resin film 24*a* of the first temperature sensor 130-1 through the incident window 25*a*, and the temperature of the resin film 24*a* increases accordingly, and the first temperature sensor 130-1 attached to the resin film 24*a* can sense the increased temperature.

As the second temperature sensor 130-2 is in closely attached to the resin film 24*b*, and the energy emitted from the fuser 200 is blocked by the shielding portion 25*b*, the second temperature can sense ambient temperature without being affected by energy emitted from the fuser 200.

Therefore, if the sensed temperature sensed by the first temperature sensor 130-1 and the compensated temperature sensed by the second temperature sensor 130-2 are measured, it is possible to compensate for the error that may be included in the sensed temperature due to the ambient influence can be corrected using the temperature, and as a result, the temperature of the fuser 200 can be detected more accurately.

Figure 6:
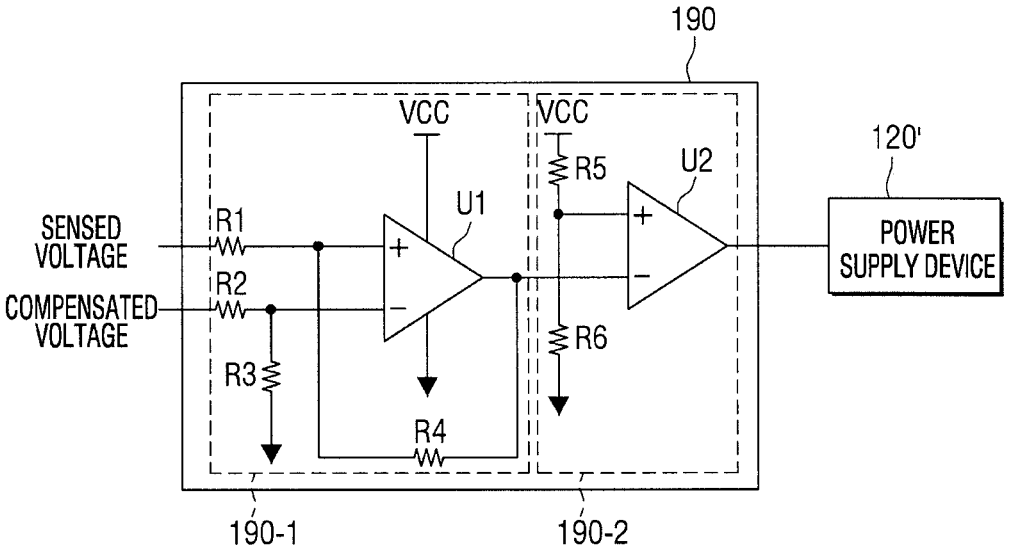
FIG. 6 is a circuit diagram of a protection circuit according to a first example.

FIG. 6 is a circuit diagram of a protection circuit according to a first example.

Referring to FIG. 6, the protection circuit 190 may include a differential amplifier 190-1 and a comparator 190-2.

First, the differential amplifier 190-1 may receive sensed voltage corresponding to sensed temperature sensed by the first temperature sensor 130-1 and compensated voltage corresponding to compensated temperature sensed by the second temperature sensor 130-2. By using the sensed voltage and the compensated voltage, an output value corresponding to (sensed voltage−compensated voltage) can be output.

The aforementioned differential amplifier 190-1 may be implemented using an OP-Amp or a transistor. When the differential amplifier 190-1 is implemented using an OP-Amp, the differential amplifier 190-1 may include a first OP-Amp U1 and a plurality of resistances R1, R2, R3, and R4.

For example, the differential amplifier 190-1 includes a first resistance R1 having one end receiving the sensed voltage and the other end connected to the positive (+) terminal of the first OP-Amp U1; a second resistance R2 having one end receiving compensated voltage and the other end connected to the negative (−) terminal of the first OP-Amp U1; a third resistance R3 having one end connected to the positive (+) terminal of the first OP-Amp U1 and the other end grounded; and a fourth resistance R4 having one end connected to the negative (−) terminal of the first OP-Amp U1 and the other end connected to the output terminal of the first OP-Amp U1; and the first OP-Amp U1.

The first OP-Amp U1 can output a value corresponding to ((sensed voltage−compensated voltage)*amplification ratio) when the sensed voltage is larger than the compensated voltage by more than offset voltage. Here, the amplification ratio can be determined by the plurality of resistances R1, R2, R3, R4, and the values of the plurality of resistances R1, R2, R3, R4 can be determined by a designer.

The first comparator 190-2 can receive the output value of the differential amplifier 190-1. By comparing the output value of the differential amplifier 190-1 with a first reference value, if the output value of the differential amplifier 190-1 is larger than the first reference value, an abnormality occurrence signal can be output.

The first comparator 190-2 may be implemented using an OP-Amp or a transistor. When the first comparator 190-2 is implemented using an OP-Amp, the first comparator 190-2 may include a second OP-Amp U2 and a plurality of resistances R5 and R6.

For example, the first comparator 190-2 may include a second OP-Amp U2 having negative (−) terminal connected to the output terminal of the first OP-Amp U1 and the output terminal connected to the power supply device 120'; a fifth resistance R5 having one end receiving a preset voltage Vcc and the other end connected to the positive (+) terminal of the second OP-Amp U2; and a sixth resistance R6 having one end connected to the positive (+) terminal of the second OP-Amp U2 and the other end grounded.

When the output value of the first OP-Amp U1 is larger than the first reference value, the second OP-Amp U2 can output a low signal corresponding to the abnormality occurrence signal. Here, the first reference value may be determined by a predetermined voltage Vcc and a plurality of resistances R5 and R6. The values of the plurality of resistances R5 and R6 can be determined by a designer.

The output low signal can be provided to the power supply device 120'.

Figure 7:
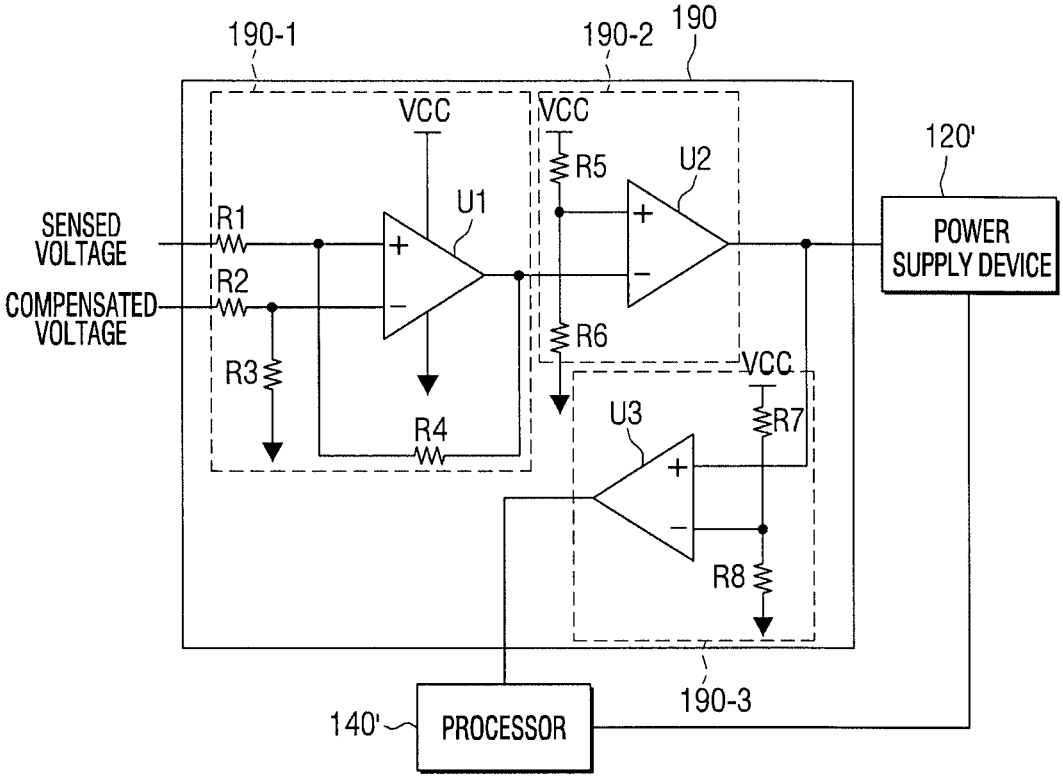
FIG. 7 is a circuit diagram of a protection circuit according to a second example.

FIG. 7 is a circuit diagram of a protection circuit according to a second example.

Referring to FIG. 7, the protection circuit 190 may include the differential amplifier 190-1, the first comparator 190-2, and the second comparator 190-3. The differential amplifier 190-1 and the first comparator 190-2 perform the same functions as those of the configuration of FIG. 6, and redundant description will be omitted.

The second comparator 190-3 can receive the output value of the first comparator 190-2. When the output value of the first comparator 190-2 is compared with the second reference value and the output value of the first comparator 190-2 is smaller than the second reference value, an abnormality occurrence signal can be output.

Here, the second comparator 190-3 may be implemented using an OP-Amp or a transistor. When the second comparator 190-3 is implemented using an OP-Amp, the second comparator 190-3 may include a third OP-Amp U3 and a plurality of resistances R7 and R8.

To be specific, the second comparator 190-3 may include third OP-Amp U3 having positive (+) terminal connected to the output terminal of the second OP-Amp U2, the output terminal connected to the processor 140'; a seventh resistance R7 having one terminal receiving a preset voltage Vcc and the other end connected to the negative (−) terminal of the third OP-Amp U3; and an eighth resistance (R8) having one terminal connected to the negative (−) terminal of the third OP-Amp U3 and other end grounded.

When the output value of the second OP-Amp U2 is smaller than the second reference value, the third OP-Amp U3 can output a low signal corresponding to the abnormality occurrence signal. Here, the second reference value may be determined by a predetermined voltage Vcc and a plurality of resistances R7 and R8. The values of the plurality of resistances R7 and R8 can be determined by a designer.

The output low signal can be provided to the processor 140'.

Figure 8:
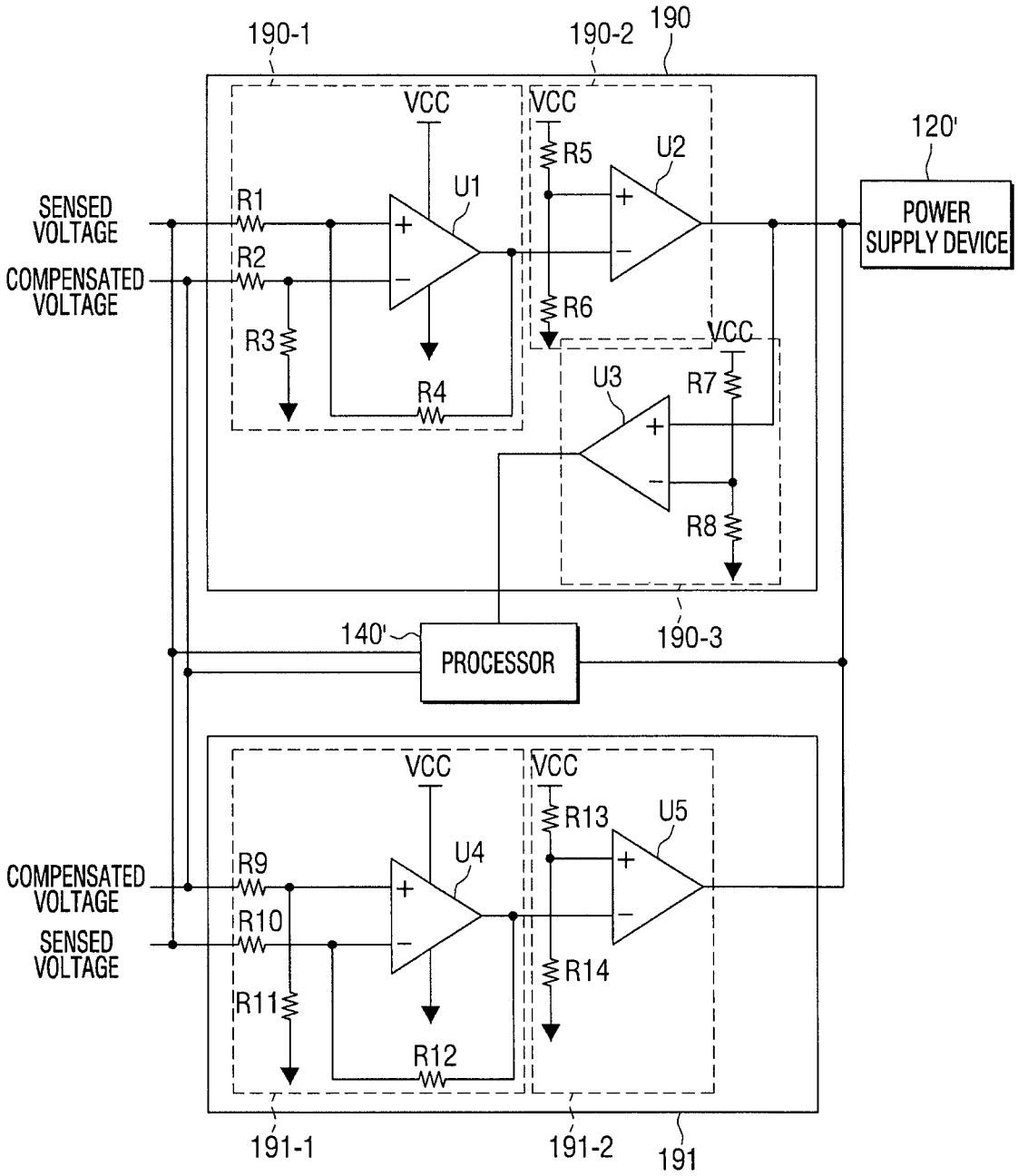
FIG. 8 is a circuit diagram of a protection circuit according to a third example, and, FIG. 9 is a flowchart to describe a fusing controlling method according to an example.

FIG. 8 is a circuit diagram of a protection circuit according to a third example.

Referring to FIG. 8, there are the first protection circuit 190 and a second protection circuit 191.

Here, the first protection circuit 190 can correspond to the protection circuit 190 of FIG. 10. The first protection circuit 190 has the same configuration as FIG. 7 and will not be further described.

The second protection circuit 191 compares the sensed voltage and the compensated voltage to determine whether or not the fuser 200 is overheated.

For example, the second protection circuit 191 compares the sensed voltage with the compensated voltage. When the compensated voltage is greater than the sensed voltage by a predetermined value or more, the second protection circuit 191 considers that the fuser 200 is overheated and may provide the overheating generation signal to the power supply device 120'.

For this end, the second protection circuit 191 may include the second differential amplifier 191-1 and the third comparator 191-2.

The second differential amplifier 191-1 may receive the sensed voltage corresponding to the temperature sensed by the first temperature sensor 130-1 and the compensated voltage corresponding to the compensated temperature sensed by the second temperature sensor 130-2. By using the sensed voltage and the compensated voltage (compensated voltage−Sensed voltage), an output value corresponding thereto can be output.

The second differential amplifier 191-1 may be implemented using an OP-Amp or a transistor. When the second differential amplifier 191-1 is implemented using an OP-Amp, the second differential amplifier 191-1 may include a fourth OP-Amp U4 and a plurality of resistances R9, R10, R11, and R12.

For example, the second differential amplifier 191-1 may include a ninth resistance R9 having one terminal receives compensated voltage and other end connected to the positive (+) terminal of the fourth OP-Amp U4; a tenth resistance R10 having one terminal receiving sensed voltage and other end connected to the negative (−) terminal of the fourth OP-Amp U4; an eleventh resistance R11 having one end connected to the positive (+) terminal of the fourth OP-Amp U4 and other end grounded; a twelfth resistance R12 having one end is connected to the negative (−) terminal of the fourth OP-Amp U4 and other end connected to the output terminal of the fourth OP-Amp U4; and the fourth OP-Amp U4.

In the fourth OP-Amp U4, if the compensated voltage is larger than the sensed voltage by more than the offset voltage, a value corresponding to ((compensated voltage−Sensed voltage)*amplification ratio) can be output. Here, the amplification ratio can be determined by a plurality of resistances R9, R10, R11 and R12, and the values of the plurality of resistances R9, R10, R11 and R12 can be determined by a designer.

The third comparator 191-2 can receive the output value of the second differential amplifier 191-1. When the output value of the second differential amplifier 191-1 is compared with the third reference value and the output value of the second differential amplifier 191-1 is larger than the third reference value, the abnormality occurrence signal can be output.

The third comparator 191-2 may be implemented using an OP-Amp or a transistor. When the third comparator 191-2 is implemented using OP-Amp, the third comparator 191-2 may include a fifth OP-Amp U5 and a plurality of resistances R13 and R14.

For example, the third differential amplifier 191-2 may include a fifth OP-Amp U5 having the negative (−) terminal connected to the output terminal of the fourth OP-Amp U4 and the output terminal connected to the power supply device 120'; a thirteenth resistance R13 having one end receiving a predetermined voltage Vcc and other end connected to the positive (+) terminal of the fifth OP-Amp U5; and fourteenth resistance R14 having one end connected to the positive (+) terminal of the fifth OP-Amp U5, and other end grounded.

The fifth OP-Amp U5 may output a low signal corresponding to the abnormality occurrence signal if the output value of the fourth OP-Amp U4 is larger than the third reference value. Here, the third reference value may be determined by a predetermined voltage Vcc and a plurality of resistances R13 and R14. The values of the plurality of resistances R13 and R14 can be determined by a designer.

The output low signal can be provided to the power supply device 120'.

The power supply device 120', when an overheating signal is received, may block power supplied to the fuser 200.

The processor 140' also receives the information about the sensed voltage and the compensated voltage from the sensor 130 to check the temperature of the fuser 200 and control the power provided to the fuser 200 based on the checked temperature.

In this way, the image forming apparatus including both the first protection circuit 190 and the second protection circuit 191 may detect whether overheating occurs in the fuser and whether abnormality occurs in the connection terminal of the temperature sensor or the temperature sensor.

Figure 9:
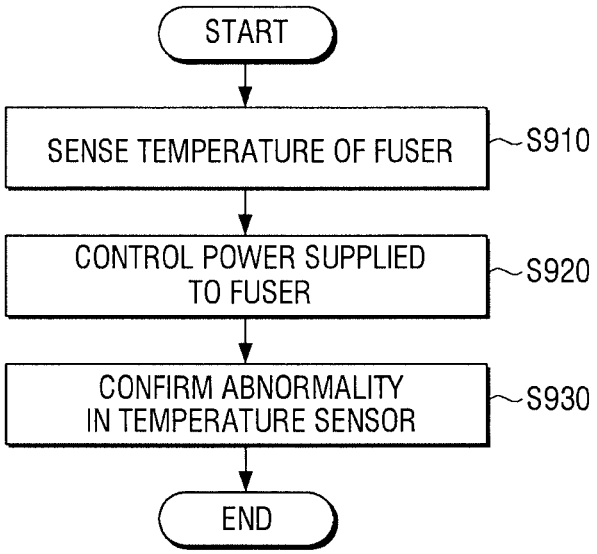

FIG. 9 is a flowchart to describe a fusing controlling method according to an example.

Referring to FIG. 9, first, the temperature of the fuser is sensed using a sensor at operation S910. For example, the sensor may be disposed at a position spaced apart from the fuser by a predetermined distance, and may sense the temperature of the fuser according to a non-contact method. Then, the sensor can output temperature information indicating the sensed temperature value which is sensed at a predetermined time interval.

The sensor may be composed of a plurality of temperature sensors. Here, the first temperature sensor can be arranged to be exposed directly to the heating roller and the second temperature sensor can be arranged to sense the ambient temperature of the first temperature sensor and the first temperature sensor without being exposed to the heating roller.

Accordingly, the first temperature sensor can sense the surface temperature of the fuser, and the second temperature sensor can detect the temperature corresponding to error which the temperature value sensed by the first temperature sensor may have due to impact of the ambience of the first temperature sensor. That is, the second temperature sensor may sense temperature which can be used to correct error which may be included in the temperature sensed by the first temperature sensor.

At operation S920, the power supplied to the fuser is controlled based on the values measured by at least one temperature sensor out of the plurality of temperature sensors. For example, by using the temperature value sensed by the at least one temperature sensor of the corridor temperature sensors, the power supply device can be controlled so that the fuser has a fusing temperature corresponding to the operation mode of the image forming apparatus.

In addition, it is possible to check whether the fuser is overheated by using the temperature values sensed by the plurality of temperature sensors, and block the power supplied to the fuser when overheating occurs. For example, when the first temperature value sensed by the first temperature sensor is greater than the second temperature value sensed by the second temperature sensor and the difference between the first temperature value and the second temperature value is greater than a predetermined value, it can be determined that overheating has occurred.

At operation S930, it is determined whether at least one temperature sensor among the plurality of temperature sensors is abnormal based on the measured temperature value using each of the plurality of temperature sensors. For example, if the second temperature value is greater than the first temperature value and the difference between the first temperature value and the second temperature value is greater than a predetermined value, it can be determined that an abnormality has occurred in the sensor.

If a sensor has abnormality, power supplied to the fuser can be blocked. In addition, a guide regarding the abnormality occurrence can be displayed to a user.

As described above, the control method of the image forming apparatus according to the present example uses the plurality of temperature values sensed by the plurality of temperature sensors to determine whether or not an abnormality occurs in the sensor or the connection terminal. Therefore, it is possible to prevent the fuser from being overheated by avoiding that a sensor having abnormality is recognized as being in a normal state.

In addition, the control method of the image forming apparatus as described above may be implemented as at least one execution program for executing the control method of the image forming apparatus as described above, and the execution program can be stored in a non-transitory computer readable medium.

Non-transitory readable medium may refer to a medium that stores data for a short period of time such as a register, a cache, and a memory, but semi-permanently stores data and is readable by the apparatus. In particular, the various applications or programs described above may be stored and provided on non-volatile readable media such as CD, DVD, hard disk, Blu-ray disk, USB, memory card, ROM.

Although the examples of the present disclosure have been illustrated and described hereinabove, the present disclosure is not limited to the abovementioned specific examples, but may be variously modified by those skilled in the art to which the present disclosure pertains without departing from the scope and spirit of the present disclosure as disclosed in the accompanying claims. These modifications should also be understood to fall within the scope of the present disclosure.

What is claimed is:

1. An image forming apparatus comprising:

a print engine including a fuser;

a power supply device to selectively provide power to the fuser;

a plurality of temperature sensors including a first temperature sensor and a second temperature sensor;

a processor to control power supplied to the fuser based on a value measured by at least one temperature sensor from among the plurality of temperature sensors; and a protection circuit including a comparator to supply an output from the comparator to the power supply device, the output corresponding to identification that the first temperature sensor among the plurality of temperature sensors has an abnormality based on a first voltage and a second voltage to the protection circuit, the first voltage corresponding to a first measured temperature value of the first temperature sensor and the second voltage corresponding to a second measured temperature value of the second temperature sensor, wherein the protection circuit, based on the second measured temperature value of the second temperature sensor being greater than the first measured temperature value of the first temperature sensor and a difference between the first measured temperature value and the second measured temperature value being equal to or greater than a preset value, is to supply the output corresponding to the identification that the first temperature sensor has the abnormality.

2. The image forming apparatus of claim 1, wherein the second temperature sensor is disposed to be adjacent to the first temperature sensor.

3. The image forming apparatus of claim 1, wherein the processor, based on the identified abnormality, is to control the power supply device to block power supplied to the fuser.

4. The image forming apparatus of claim 1, further comprising:

a display, wherein the processor, based on the identified abnormality, is to control the display to display a guide on error occurrence on the first temperature sensor.

5. A fusing control method of an image forming apparatus, the method comprising:

controlling, by a processor, power supplied from a power supply device to a fuser based on a value measured by at least one temperature sensor from among a plurality of temperature sensors including a first temperature sensor and a second temperature sensor; and supplying an output from a comparator included in a protection circuit to the power supply device, the output corresponding to identification that the first temperature sensor has an abnormality based on a first voltage and a second voltage to the protection circuit, the first voltage corresponding to a first measured temperature value of the first temperature sensor and the second voltage corresponding to a second measured temperature value of the second temperature sensor, wherein the supplying the output corresponding to the identification that the first temperature sensor has the abnormality comprises, supplying the output corresponding to identification that the first temperature sensor has the abnormality based on the second measured temperature value of the second temperature sensor being greater than the first measured temperature value of the first temperature sensor and a difference between the first measured temperature value and the measured second temperature value being equal to or greater than a preset value.

6. The method of claim 5, wherein the second temperature sensor is disposed to be adjacent to the first temperature sensor.

7. The method of claim 5, further comprising: based on the identified abnormality, blocking power supplied to the fuser.

8. The method of claim 5, further comprising:

based on the identified abnormality, displaying a guide on error occurrence on the first temperature sensor.

9. An image forming apparatus, comprising:

a print engine including a fuser;

a power supply device to selectively provide power to the fuser;

a plurality of temperature sensors including a first temperature sensor and a second temperature sensor; and a protection circuit including a comparator to supply an output from the comparator to the power supply device, the output corresponding to identification that the first temperature sensor has an abnormality among the plurality of temperature sensors based on a first voltage and a second voltage to the protection circuit, the first voltage corresponding to a first measured temperature value of the first temperature sensor and the second voltage corresponding to a second measured temperature value of the second temperature sensor of the plurality of temperature sensors, wherein the protection circuit, based on the second measured temperature value of the second temperature sensor being greater than the first measured temperature value of the first temperature sensor and a difference between the first measured temperature value and the second measured temperature value being equal to or greater than a preset value, is to supply the output corresponding to the identification that the first temperature sensor has the abnormality.

10. The image forming apparatus of claim 9, wherein the second temperature sensor is disposed to be adjacent to the first temperature sensor.

11. The image forming apparatus of claim 10, wherein the protection circuit comprises:

a first comparator to compare a first voltage that is an output value of the first temperature sensor and a second voltage that is an output value of the second temperature sensor; and the comparator as a second comparator to compare the output value of the first comparator and a preset value, wherein the output from the second comparator is to be supplied to the power supply device.

12. The image forming apparatus of claim 11, wherein the first comparator comprises:

a first operational amplifier (OP-Amp);

a first resistance of which one terminal receives the first voltage and another terminal is connected to a positive (+) terminal of the first operational amplifier (OP-Amp);

a second resistance of which one terminal receives the second voltage and another terminal is connected to a negative (−) terminal of the first operational amplifier (OP-Amp);

a third resistance of which one terminal is connected to a positive (+) terminal of the first OP-Amp, and another terminal is grounded; and a fourth resistance of which one terminal is connected to a negative (−) terminal of the first OP-Amp, and another terminal is connected to an output terminal of the first operational amplifier (OP-Amp).

13. The image forming apparatus in claim 11, wherein the second comparator comprises:

a second operational amplifier (OP-Amp) of which a negative (−) terminal is connected to an output terminal of the first operational amplifier (OP-Amp), and the output terminal is connected to the power supply device;

a fifth resistance of which one end receives a preset voltage and another end is connected to a positive (+) terminal of the second operational amplifier (OP-Amp); and a sixth resistance of which one end is connected to a positive (+) terminal of the second operational amplifier (OP-Amp) and another terminal is grounded.

* * * * *